US006651560B2

(12) United States Patent
Neuhaus

(10) Patent No.: US 6,651,560 B2
(45) Date of Patent: Nov. 25, 2003

(54) METHOD, DEVICE AND PRINTING FORM FOR TRANSFERRING FREE-FLOWING PRINTING INK ONTO A PRINTING MATERIAL

(75) Inventor: Dietmar Neuhaus, Düsseldorf (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 107 days.

(21) Appl. No.: 09/899,696

(22) Filed: Jul. 5, 2001

(65) Prior Publication Data

US 2002/0000190 A1 Jan. 3, 2002

Related U.S. Application Data

(63) Continuation of application No. PCT/EP99/10478, filed on Dec. 31, 1999.

(30) Foreign Application Priority Data

Jan. 4, 1999 (DE) ..... 199 00 046

(51) Int. Cl.[7] ..... B41J 2/18; B41N 1/00

(52) U.S. Cl. ..... 101/401.1; 101/116; 101/114; 101/129; 347/91

(58) Field of Search ..... 101/114, 116, 101/121, 127, 129, 487, 488, 401.1, 153, 155, 156, 157, 170; 347/91

(56) References Cited

U.S. PATENT DOCUMENTS 1,668,322 A * 5/1928 Kessler, Jr. ..... 101/152
3,545,374 A * 12/1970 Hendricks, Jr. ..... 347/127
3,752,746 A * 8/1973 Castegnier ..... 205/54
4,263,601 A * 4/1981 Nishimura et al. ..... 347/55
4,550,324 A * 10/1985 Tamaru et al. ..... 347/187
4,740,801 A * 4/1988 Shimazaki ..... 347/66
4,797,693 A * 1/1989 Quate ..... 347/43
6,330,857 B1 * 12/2001 Maximovsky et al. ..... 101/116

FOREIGN PATENT DOCUMENTS

DE 295 15 858 U1 2/1996
DE 195 44 099 A1 5/1997
DE 197 46 174 C1 7/1999

* cited by examiner

*Primary Examiner*—Leslie J. Evanisko
(74) *Attorney, Agent, or Firm*—Laurence A. Greenberg; Werner H. Stemer; Ralph E. Locher

(57) ABSTRACT

A printing form for transferring free-flowing printing ink to a printing material to be printed includes a body having a surface formed with a multiplicity of openings coverable by printing ink; a multiplicity of gas-containing cavities formed in the body, the cavities, respectively, terminating in the openings, respectively, at the surface of the body; and devices assigned to the cavities, respectively, for producing a vacuum therein for sucking printing ink covering the openings of the cavities into a region adjacent to the openings of the cavities, respectively, when a vacuum is produced by devices in the cavities, respectively; an ink transferring device including the printing form; and a method of producing the printing form.

47 Claims, 5 Drawing Sheets

METHOD, DEVICE AND PRINTING FORM FOR TRANSFERRING FREE-FLOWING PRINTING INK ONTO A PRINTING MATERIAL

CROSS-REFERENCE TO RELATED APPLICATIONS

This application is a continuation of copending International Application No. PCT/EP99/10478, filed Dec. 31, 1999, which designated the United States.

BACKGROUND OF THE INVENTION

1. Field of the Invention

The invention relates to a method, a device and a printing form for transferring free-flowing printing ink onto a printing material.

Printing processes are known wherein fluid or liquid printing ink is transferred to printing material by contact between a printing form and the printing material. In these conventional processes, the patterns to be printed are applied to the printing form. The patterns can be applied in the form of depressions or elevations to an area. Printing ink is then applied to the elevations (letter press) or forced into the depressions (gravure), and transferred to the printing material by contact with the printing material.

The aforementioned processes have the disadvantage that each new pattern to be printed requires a new printing form.

2. Summary of the Invention

It is accordingly an object of the invention, therefore, to provide a method and a device for printing on printing materials whereon different patterns are printable with only one printing form.

With the foregoing and other objects in view, there is provided, in accordance with a first aspect of the invention, a printing form for transferring free-flowing printing ink to a printing material to be printed, comprising a body having a surface formed with a multiplicity of openings coverable by printing ink; a multiplicity of gas-containing cavities formed in the body, the cavities, respectively, terminating in the openings, respectively, at the surface of the body; and devices assigned to the cavities, respectively, for producing a vacuum therein for sucking printing ink covering the openings of the cavities into a region adjacent to the openings of the cavities, respectively, when a vacuum is produced by the devices in the cavities, respectively.

In accordance with another feature of the invention, the devices, respectively, for producing a vacuum in the respective cavities have a cooling device for at least one of cooling a gas in the cavity and letting a gas in the cavity cool, the cooling device serving for at least one of cooling the gas in the cavity and letting the gas in the cavity cool, when the respective opening of the respective cavity is covered with printing ink, for subjecting the gas in the cavity to a vacuum for sucking the printing ink into the cavity.

In accordance with a further feature of the invention, the devices, respectively, for producing a vacuum in the respective cavities have a heater for heating the gas in the respective cavities by previously heating the gas in the respective cavities and, then, at least one of cooling the gas in the respective cavities and letting the gas cool, when the respective opening of the respective cavity is covered with printing ink, for subjecting the gas in the cavity to a vacuum for sucking the printing ink into the cavity.

In accordance with an added feature of the invention, the heater is formed as a resistance heating element.

In accordance with an additional feature of the invention, the heater is formed as a heating element heatable by absorption of electromagnetic radiation.

In accordance with yet another feature of the invention, the heating element has a metal oxide.

In accordance with yet a further feature of the invention, the devices for producing a vacuum in the respective cavities are operative by one of inductively, capacitively and resistively coupling energy into gas volumes in the respective cavities.

In accordance with yet an added feature of the invention, the devices for producing a vacuum in the respective cavities are operative by absorption of electromagnetic radiation by gas volumes in the respective cavities.

In accordance with yet an additional feature of the invention, the respective devices for producing a vacuum in the respective cavities have at least one wall region which is at least one of deformable and movable for changing the volume of the respective cavities, so that when the respective openings of the respective cavities are covered with printing ink, the gas therein is subjectible to a vacuum that sucks printing ink into the respective cavities by at least one of deforming and moving the respective wall regions for the purpose of enlarging the volume of the respective cavities.

In accordance with still another feature of the invention, the wall regions of the respective cavities are prestressed into a first position, and an actuator is included for transferring the wall regions from the first position thereof into a second position thereof, the volume of the respective cavities in the first position of the wall region being greater than in the second position thereof.

In accordance with still a further feature of the invention, the vacuum-producing devices are energizable by at least one of capacitive coupling, inductive coupling, and electromagnetic radiation.

In accordance with still an added feature of the invention, the printing form includes devices assigned to the cavities for participating in applying printing ink from the respective cavities to the printing material.

In accordance with still an additional feature of the invention, the devices for participating in applying printing ink to a printing material, and the devices for producing a vacuum in the cavities have common elements arranged on the body.

In accordance with another feature of the invention, the cavities are positively pressurizable for at least partially ejecting printing ink therefrom.

In accordance with a further feature of the invention, a respective wall region of the cavities is one of deformable and movable for reducing the volume thereof so as to eject at least part of the printing ink from the respective cavities.

In accordance with an added feature of the invention, the gas in the respective cavities is heatable so as to eject at least part of the printing ink from the respective cavities.

In accordance with an additional feature of the invention, the devices for producing a vacuum in the respective cavities are operatable so that vacuums of different strengths are settable in the respective cavities for sucking into the respective cavities different quantities of printing inks.

In accordance with yet another feature of the invention, the devices for participating in applying printing ink from the respective cavities to the printing material are differently operatable for applying different quantities of the printing ink.

In accordance with yet a further feature of the invention, the printing form includes devices for participating in applying printing ink from the respective cavities to the printing material, the devices for participating in applying printing ink being operatable in accordance with the operation of the devices for producing the vacuum in the respective cavities.

In accordance with yet an added feature of the invention, the gas in the cavities is air.

In accordance with a second aspect of the invention, there is provided a printing form for transferring free-flowing printing ink to a printing material to be printed, comprising a body having a surface formed with a multiplicity of openings, a multiplicity of cavities formed in the body and terminating in the openings, respectively, the cavities being filled with gas, and heaters assigned to the cavities, respectively, for heating the gas in the cavities, whereby, after heating the gas in a respective cavity, covering the opening of the cavity with printing ink, and subsequently having the gas in the cavity cooled, the printing ink is sucked into a region close to the opening of the cavity.

In accordance with another feature of the invention, the heater in the cavity is constructed as a resistance heating element.

In accordance with a further feature of the invention, the heater is constructed as a heating element heatable by absorption of electromagnetic radiation.

In accordance with an added feature of the invention, the heating element has a metal oxide.

In accordance with an additional feature of the invention, at least one of, on the one hand, the devices for producing the vacuum in the respective cavities in the body and, on the other hand, a gas volume in the cavity, serve for providing energy for producing a vacuum in a respective cavity in the body by at least one of capacitive coupling, inductive coupling and electromagnetic radiation.

In accordance with yet another feature of the invention, the printing form includes devices assigned to the cavities for participating in applying printing ink from one of the cavities, respectively, to the printing material.

In accordance with yet a further feature of the invention, the devices for participating in applying printing ink to the printing material, and the devices for producing a vacuum in the cavities have common elements arranged on the body.

In accordance with yet an added feature of the invention, the gas in the respective cavity is heatable for ejecting at least part of the printing ink from the respective cavity.

In accordance with yet an additional feature of the invention, the devices for producing vacuum in the cavities are operatable so that vacuums of different strength are settable in the cavities for sucking different quantities of printing inks into the cavities.

In accordance with still another feature of the invention, the devices for participating in applying printing ink from the cavities to the printing material are operatable differently for applying different quantities of printing ink.

In accordance with still a further feature of the invention, the devices for applying printing ink from the cavities to the printing material are operatable in accordance with the operation of the devices for producing the vacuum in the cavities.

In accordance with still an added feature of the invention, the gas in the cavities is air.

In accordance with a third aspect of the invention, there is provided a device for transferring free-flowing printing ink from a printing form to a printing material, comprising a transport device for transporting, along a transport path, printing material to be printed, and a printing form past the surface of which the printing material is movable, the printing form including a body having a surface formed with a multiplicity of openings coverable by printing ink; a multiplicity of gas-containing cavities formed in the body, the cavities, respectively, terminating in the openings, respectively, at the surface of the body; and devices assigned to the cavities, respectively, for producing a vacuum therein for sucking printing ink covering the openings of the cavities into a region adjacent to the openings of the cavities, respectively, when a vacuum is produced by the devices in the cavities, respectively.

In accordance with a fourth aspect of the invention, there is provided a method for transferring free-flowing printing ink from a printing form to a printing material, which comprises sucking printing ink into cavities opening into openings formed in the surface of the printing form, the printing ink being located within the openings and in regions adjacent to the openings of the cavities, and applying the printing ink from the cavities to the printing material.

In accordance with another mode, the method of the invention includes applying the printing ink to the printing material from the cavities by exerting excess pressure in the cavities.

In accordance with a further mode, the method of the invention includes sucking printing ink into the openings and into the regions adjacent to the openings of all the cavities in a group of the cavities, and performing the application by a selective application of excess pressure within selected cavities in this group of cavities.

In accordance with an added mode, the method of the invention includes sucking printing ink into the openings of selected cavities in a group of cavities and into the regions adjacent to the openings.

In accordance with an additional mode, the method of the invention includes performing the application of the printing ink from cavities selectively having printing ink in a group of cavities by applying excess pressure in all the cavities of a group of cavities.

In accordance with yet another mode, the method of the invention includes, for sucking printing ink into a cavity, covering the opening thereof with printing ink and then producing a vacuum in the cavity.

In accordance with yet a further mode, the method of the invention includes producing the vacuum in a cavity by cooling the gas volume of the cavity while covering the opening of the cavity with printing ink.

In accordance with yet an added mode, the method of the invention includes heating the gas volume of a cavity before the opening of the cavity is covered with printing ink.

In accordance with yet an additional mode, the method of the invention includes providing a heater for performing the heating.

In accordance with still another mode, the method of the invention includes, for heating the gas in the cavity, providing at least one of direct inductive, capacitive and resistive coupling of energy and absorption of electromagnetic radiation by the gas.

In accordance with still a further mode, the method includes enlarging the volume of the cavity for producing the vacuum in the cavity.

In accordance with still an added mode, the method includes participating in applying printing ink from a cavity to printing material by producing excess pressure in the respective cavity.

In accordance with still an additional mode, the method includes producing the excess pressure in the respective cavity by heating the gas volume in the cavity while covering the opening thereof with printing ink.

In accordance with another mode, the method of the invention includes producing the excess pressure by reducing the gas volume in the cavity while covering the opening thereof with printing ink.

In accordance with a further mode, the method of the invention includes setting the vacuum in the cavity to different values.

In accordance with an added mode, the method of the invention includes setting the excess pressure in the cavity to different values.

In accordance with a concomitant mode, the method includes filling the cavities with air.

The stated object of the invention is achieved by providing a screen or grid of fine openings being in the surface of the printing form. The fine openings form the grid points from which a pattern to be printed can be built up. In accordance with the predefined pattern, individual openings, i.e., grid points, are selected into which printing ink is sucked in accordance with the method of the invention. Each of the openings opens into a cavity which is located behind it and which can be heated and cooled by suitable devices, as a result of which the gases in the cavity are heated or cooled and, in this way, the gas temperature in the cavity is changed. For each cavity there is only one opening, specifically, that which is formed in the surface of the printing form. The gas pressure in front of an opening and in the cavity located behind it is the same when the opening is clear. Printing ink is drawn into an opening when the opening is covered in a gastight manner with printing ink after the heating of the gases in a selected cavity, and the gas temperature in the cavity is then reduced again. As a result of reducing the gas temperature in the cavity, the gas pressure in the cavity is reduced. This causes the outer, now higher gas pressure to press printing ink into the opening.

The surface properties of the printing form and the properties of the printing ink are expediently matched to one another in such a way that the printing ink does not wet the fine openings in the printing form, and therefore without any pressure difference between a cavity and the outer surroundings, no printing ink can get into the associated opening.

Printing a predefined pattern, respectively, for one color, is carried out by specific heating of individual cavities in the printing form, the surface of the printing form then being covered with printing ink and therefore all the openings being covered in a gastight manner with printing ink, and then the gas temperature of the selected cavities being reduced again by cooling. Openings are then filled with printing ink in accordance with the predefined pattern, or else are quite free of printing ink. Ink residues which are located at the surface of the printing form, between the openings, should be removed by a suitable device. This can be done, for example, with the aid of a doctor blade or can be implemented by configuring the regions of the surface of the printing form between the openings as repelling printing ink. Printing can then be performed by contact between the printing form and the printing material. The resolution with which the printed image is produced depends upon the distances between the openings.

Following a printing, it may be necessary to remove ink residues from the printing form. Residues of the printing ink can be removed from the printing form by a suitable device. Ink residues can, for example, be wiped off.

The printing method according to the invention makes it possible, depending on predefinition, to transfer a different amount of printing ink per grid point to the printing material by the gas in the cavities being heated to a different extent. This results in different gas temperatures in the heated cavities, which, in the case of otherwise identical cavities, following the cooling, leads to different amounts of printing ink being pressed into the openings, and therefore, advantageously, it is possible for different amounts of printing ink per grid point to be transferred to the printing material.

The openings in the printing form do not have to have a circular cross-sectional area; areas differing therefrom are conceivable. For the dimensioning of the opening, there is an upper and a lower limit. The openings may not be too small, because otherwise the pressure difference may no longer be sufficient to press printing ink into the opening counter to the effect of the surface tension thereof. However, the opening may not become too large either, because otherwise the pressure difference may no longer be sufficient to keep printing ink in the openings counter to the action of gravity.

Printing ink can be applied to the printing form in different ways. It is possible to spread on or spray on printing ink. Particularly advantageously, however, the printing form can also be dipped into the printing ink. In this case it is important that openings of the cavities filled with heated gas be covered in a gastight manner by printing ink before the gas filling is cooled down again. Printing ink penetrates into an opening only as a result of the cooling of the gas filling. The application of the printing ink, the size of the openings and the surface properties of the printing form and the printing ink should expediently be matched to one another in such a way that no printing ink penetrates into the openings merely as a result of the application.

One significant aspect of the invention is the production of a vacuum by heating the gas filling in the cavities in the printing form and subsequent cooling. Different techniques are suitable to bring about the heating. Heating can be carried it out via an electric resistance heater if each of the cavities in the printing form is equipped with a resistance heater which can be switched on and off individually. Energy for heating the gas filling can, however, also be provided by inductive or capacitive coupling of electrical energy into the vicinity of the cavities, which is ultimately converted into thermal energy. Particularly suitable for the printing method according to the invention is the transmission of energy for heating the gas filling by electromagnetic radiation and here, in particular, the transmission of energy with laser light. In the last three cases mentioned, the energy is converted into heat by associated elements in the cavities or adjacent to the latter.

Alternatively, the heating of the gas filling can also be performed by the direct inductive, capacitive or resistive coupling of energy into the gas. It is also possible to heat gas fillings by the direct absorption of electromagnetic radiation by the gas.

The use of air as gas in the cavities offers the advantage that two physical properties of air can advantageously be utilized for the invention. To be specific, air has a good temperature conductivity, that is to say, that an air volume can be heated up very quickly. This is advantageous with regard to the invention inasmuch as those cavities into which the printing ink is to be sucked can be heated up very quickly, which leads to short printing cycle times. Furthermore, however, air has a relatively poor thermal conductivity, and is therefore not suitable for the transport of heat. This effect, inasmuch as it has an insulating action, has the advantage in the invention that the printing form is subjected only to low heating in the vicinity of the cavities.

The individual cavities in the printing form should be adequately well thermally insulated with respect to one another, in order that gas fillings in cavities can be heated specifically without likewise heating gas fillings of cavities in the immediate neighborhood, as a result, so that it is reliably possible to prevent printing ink from being sucked into openings which are not intended to be filled with printing ink to print the predefined pattern, following the covering of the openings with printing ink and the cooling of the gas filling.

The measure of adequately good thermal insulation is also influenced by the time period between starting the heating of the gas filling in a cavity and covering the associated opening with printing ink. Lengthening the time period requires an improvement in the thermal insulation between the cavities, in order to keep temperature changes in the cavities, as a result of heat conduction between the cavities, to a non-damaging low level.

The printing form can be a flat or curved plate; constructing the printing form as a hollow cylinder is particularly suitable.

After the gastight covering of the openings to the cavities with heated or non-heated gas fillings by printing ink, the heated gas filling must be cooled down suitably. Cooling can be performed, for example, via a gas flow which acts upon at least parts of the outer surface of the cavities. Part of the cooling effect can also originate from the printing ink if gas from a heated gas filling comes into contact with the cooler printing ink.

As a result of the cooling, the gas temperature should not fall below that of the gas surrounding the printing form from outside, because otherwise, after the gastight covering with printing ink, a vacuum which can force printing ink into openings is also produced in cavities with non-heated gas fillings.

The transfer of printing ink from the printing form according to the invention to the printing material can be assisted by heating gas fillings in the cavities in the printing form. Heating the gas filling in a cavity leads to an increase in pressure in the cavity if the associated opening is filled in a gastight manner with printing ink. As a result of the increase in pressure, printing ink is then pressed out of the opening. The printing ink can then be taken up easily by the printing material.

Following the transfer or application of printing ink to the printing material, care is taken, by cooling the cavities, that the gas temperatures in the cavities are equalized. This serves as a preparation for a new printing cycle. A printing cycle is composed of heating the gas fillings of selected cavities, subsequently covering the openings with printing ink, subsequently cooling heated gas fillings, then removing excess printing ink and finally transferring printing ink from openings in the printing form to the printing material. The transfer/application can in this case be assisted by heating gas fillings in cavities.

Alternatively, printing a pattern can also be performed by, initially filling openings in the printing form with printing ink in the manner described above, and the pattern on the printing material being produced by only selected cavities being heated and only printing ink then getting onto the printing material from the openings belonging to the cavities, if appropriate in different quantities, as a result of different heating. Printing executed in this way presupposes that, without the heating of gas fillings in cavities, no printing ink can get onto the printing material. This means that printing ink may be present only in the openings.

Alternatively to the aforedescribed variation in the generation of pressure in the cavities by heating and cooling the gas filling in the cavity, a change in the pressure in the cavity, after the covering of the opening of the cavity with printing ink, can be performed by a volume change of the cavity. The volume change in the cavity can be achieved through the intermediary of a deformable and/or movable wall region (for example by a piston or diaphragm). An enlargement of the volume of the cavity after it is covered with printing ink leads to a pressure reduction in the cavity. Consequently, printing ink will be sucked in. An increase in pressure in the cavity is achieved by a volume reduction. The pressure increase in the cavity can assist the transfer of ink from the printing form to the printing material.

The vacuum-producing device is expediently formed by a deformable and/or movable wall region belonging to the cavity, the wall region being prestressed into a first position and being capable of being transferred from the latter into a second position by an actuator, and the volume of the cavity in the first position of the wall region being greater than in the second position. This device can also be used to apply or to assist the application of the printing ink from the cavity, by the volume of the cavity being reduced via the wall region.

In general terms, therefore, the invention is to be seen in terms of a printing form which is provided with a body with a surface which has a large number of openings, a large number of cavities in the body, which end in the openings at the surface of the body and contain gas, and devices associated with each cavity for producing a vacuum in the relevant cavity, where, by producing a vacuum in a cavity after the opening of the cavity has been covered with printing ink, the latter can be sucked into the region close to the opening of the cavity.

As already mentioned above, it is expedient to produce the vacuum by changing the temperature of the gas of a cavity. The device for producing a vacuum in a cavity therefore expediently has a cooling device to cool the gas in the cavity and/or to let the gas cool, it being possible, by cooling the gas in a cavity and/or letting said gas cool, with the opening of the cavity covered with printing ink, for the gas in the cavity to be subjected to a vacuum that sucks printing ink into the cavity.

If the vacuum is produced by previously heating the gas of a cavity and subsequently cooling it (with the cavity opening covered by printing ink), the heater required for this purpose is, for example, constructed as a resistance heating element. The heater is located in the cavity or in thermal contact with the latter or the wall thereof. Alternatively, the heater in a cavity can be constructed as a heating element which heats up by absorption of electromagnetic radiation, this absorption heating element having, in particular, a metal oxide.

Finally, it is also possible for the heater to be implemented by an energy source, the energy of which is coupled into gas volumes in the cavities inductively, capacitively or resistively, or for the energy source to emit electromagnetic radiation which is absorbed by gas volumes in the cavities.

In the method according to the invention, therefore, the printing ink is sucked into cavities opening into the openings in the surface of the printing form, the printing ink being located within the openings and the regions close to the openings of the cavities, and the printing ink being applied to the printing material from the cavities.

Conversely, by applying a positive pressure, printing ink previously sucked into the cavity can be applied to the printing material from the cavity, or the application can be assisted.

The invention advantageously provides for printing ink to be sucked into the openings and into the regions close to the openings of all the cavities of a group of cavities, and for the application to be carried out by selective application of a vacuum within selected cavities of this group of cavities. The groups of cavities mentioned here are, for example, one or more rows of cavities arranged beside one another or above one another on the surface of the printing form. While, in the case of this variation, all the cavities in a group are provided with printing ink, in order then to print selectively by selective driving of the cavities, this alternate procedure provides for the printing ink to be sucked into the openings and into the regions close to the openings of selected cavities in a group of cavities and, in addition, in particular, the application of the printing ink is performed from cavities selectively having printing ink in a group of cavities by positive pressure in all the cavities in a group of cavities.

Other features which are considered as characteristic for the invention are set forth in the appended claims.

Although the invention is illustrated and described herein as embodied in a method, a device and a printing form for transferring free-flowing printing ink onto a printing material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
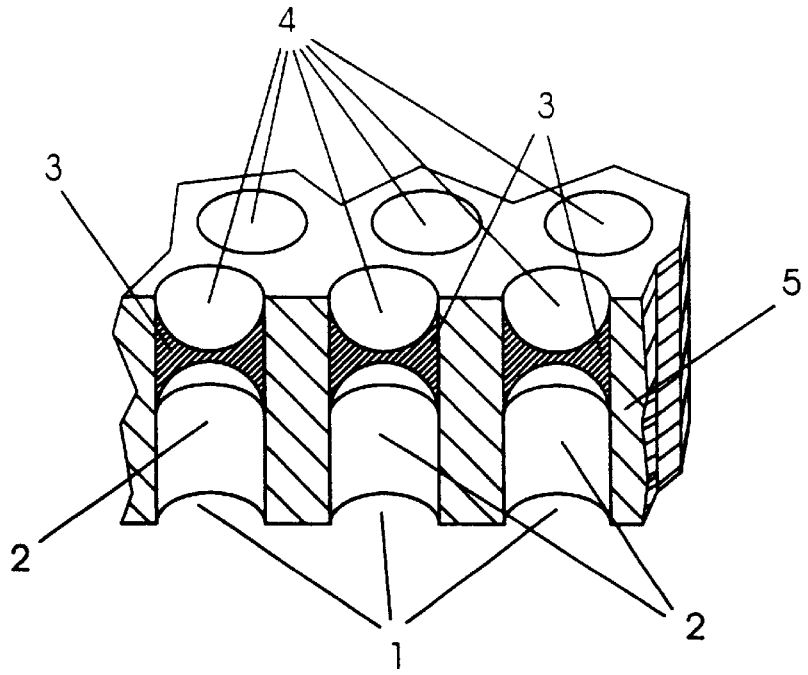
FIGS. 1 and 2 are fragmentary perspective views, partly broken away and in section, of two exemplary embodiments, respectively, of a printing form, showing respective flat and curved surfaces thereof.
Figure 2:
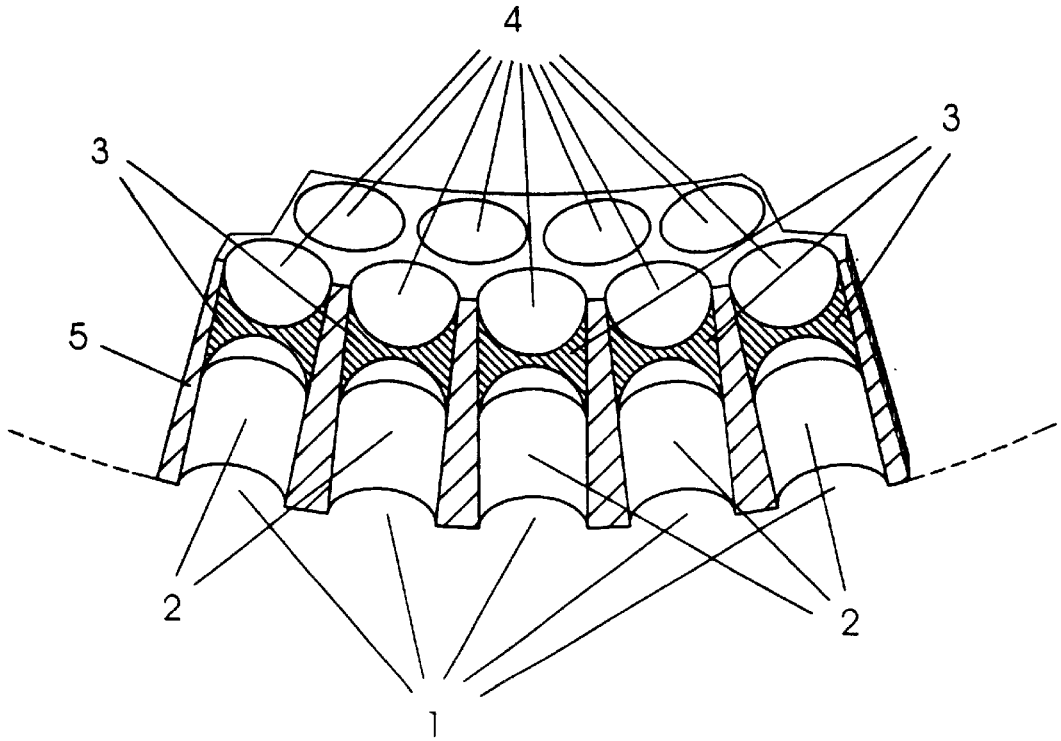

Referring now to the drawings and, first, particularly to FIGS. 1 and 2 thereof, there is shown in FIG. 1, an exemplary embodiment of a flat printing form and, in FIG. 2, a curved printing form. The curved part of a printing form can also be part of a printing form formed as a hollow cylinder. A feature of the printing form is a raster or screen of openings 1, introduced into a flat or curved plate, or on the outer surface of a hollow cylinder. Cavities 2, respectively, are arranged behind the openings 1. Each cavity 2 has only the respective opening 1, and is therefore only open towards the surface of the printing form. Printing ink can be sucked into the openings 1. One side, respectively, of the cavities 2 is formed by a plug 3 of a material which conducts heat well. The heat conduction through the plug 3 ensures that thermal energy in the plug 3, applied for example as a result of the absorption of laser light, is transferred to the volume of gas in the cavity 2 by heat conduction. The irradiation with the laser light is performed in depressions 4, respectively, associated with individual openings. In order to cool the quantity of gas, a gas jet can be aimed at the depressions 4. The individual openings 1, the cavities 2, the plugs 3 and the 1S depressions 4 are embedded in a matrix 5, which ensures the required thermal insulation between the different openings 1, the cavities 2, the plugs 3 and the depressions 4.

Figure 3:
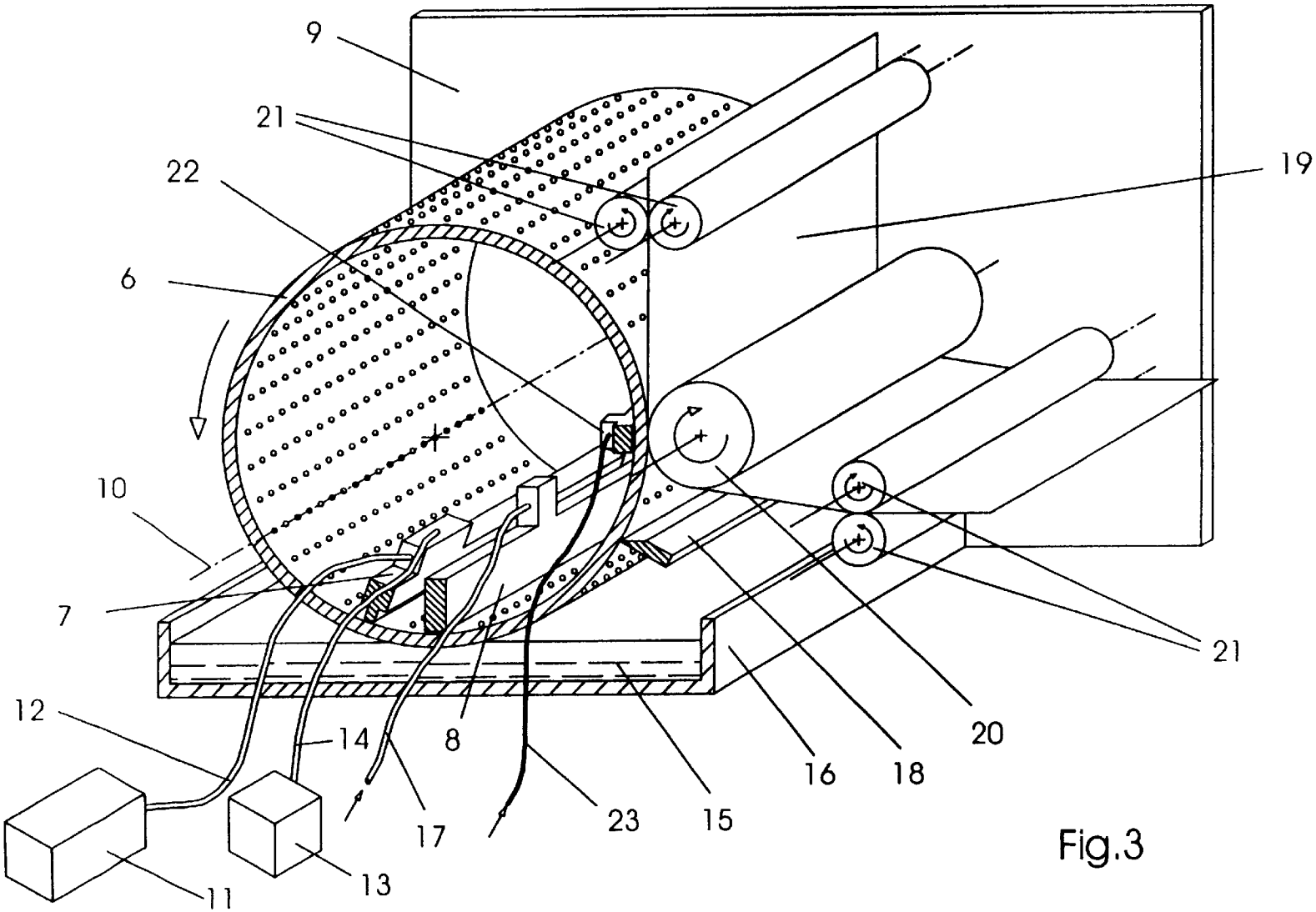
FIG. 3 is a perspective diagrammatic and schematic view of the printing form, shown partly broken open.

FIG.3 illustrates an exemplary embodiment of a printing system. In this example, the printing form 6 is a hollow cylinder corresponding to that of FIG. 2, with the openings 1 for the input of ink located on the outer side of the hollow cylinder. Heating bars 7 and cooling bars 8 are arranged on the inner side of the hollow cylinder. They extend over the complete length of the printing form 6, and permit the heating and cooling of cavities in the printing form 6. The printing form rotates about a shaft diagrammatically illustrated by the axis 10 thereof, which is connected to a frame 9. The heating bars 7 and the cooling bars 8 are connected to the frame 9. The heating bar 7 has the task of heating cavities 2 in the printing form 6 in accordance with the pattern to be printed, in this construction, only one strip-like region of the printing form 6 being located under the heating bar 7. The heating bar 7 has devices which guide laser light into the depressions 4 in accordance with the pattern to be printed. In a depression 4, laser light is absorbed and converted into thermal energy and, in this way, a quantity of gas is ultimately heated. The laser light is guided into the heating bar 7 from an externally arranged laser 11 via optical fibers 12. Control signals for deflecting the laser light into the individual depressions in the printing form are prepared in an external appliance 13 and fed into the heating bar 7 via a cable 14. Due to the rotation of the printing form 6 about the axis 10, the printing form 6 is moved past the heating bar 7. After respective cavities 2 have passed the heating bar 7, the associated openings 1 are covered with printing ink 15 by the fact that the outer surface of the printing form is dipped into the printing ink 15. The printing ink 15 is provided in a trough 16 under the printing form 6. At the same time as the openings are dipped and covered, cavities are cooled by the cooling bar 8. The cooling bar 8 covers a strip of the printing form 6, and the cooling is performed via a gas flow which is guided into the depressions 4 moved past the cooling bar 8. The cooling air is supplied to the cooling bar 8 via a hose line 17. Due to the cooling, the gas pressure in the previously heated cavities is reduced and, in this way, printing ink is pressed into the openings.

The cavities can be heated to different extents and, in this way, different quantities of printing ink are advantageously pressed into the corresponding openings.

A blade-type doctor 18 strips excess ink off the printing form 6 before the printing form 6 is brought into contact with the printing material 19, and printing ink passes from the openings 1 to the printing material 19. The roll 20 presses the printing material 19 against the printing form 6.

The printing material 19 is guided by the rollers 21. By using the heating bar 22, which extends over the entire width of the printing form 6, the quantity of gas in the cavities in the printing form 6 are heated with respect to the roller 20. In this way, the transfer of the printing ink from the openings 1 in the printing form 6 to the printing material 19 is assisted. A feed line 23 supplies the heating bar 22 with the necessary energy.

According to a further exemplary embodiment (note FIG. 4), the printing form is constructed as a thin-walled tube, into which the cavities and the openings are machined. In particular, in the case of wide print formats, the task then arises of stabilizing the printing form mechanically for the printing operation. For this purpose, the printing form can be connected at the tube ends thereof to tensioning elements which exert a tensile stress on the printing form parallel to the tube axis thereof and, in this way, align the printing form and stabilize it mechanically. Particularly advantageously, a thin-walled printing form can be stabilized mechanically by a gas cushion.

Figure 4:
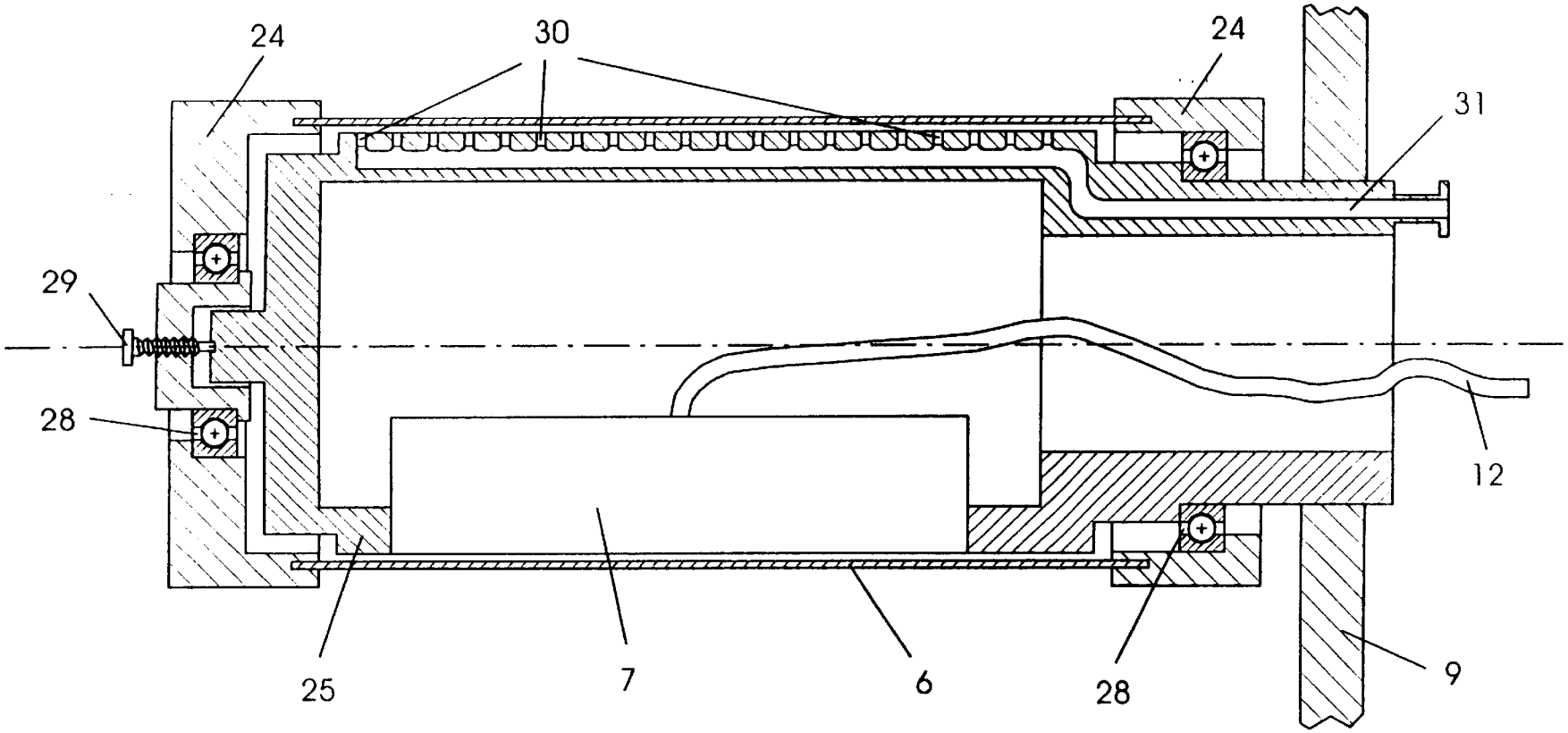
FIG. 4 is a longitudinal sectional view of a printing form according to the invention, which has an alternative configuration to that of FIG. 3.

FIG. 4 illustrates a tubular, thin-walled printing form 6 which is connected at the ends thereof to tensioning elements 24. The printing form 6 and the tensioning elements 24 are slid or pushed over a mandrel 25. The mandrel 25 is firmly connected to a frame 9. The tensioning elements 24 and the printing form 6 are arranged so as to be rotatable about the mandrel 25, and are guided by bearings 28. With the aid of a tensioning screw 29, tensile stress can be exerted on the printing form 6, aligning the printing form 6 and stabilizing it mechanically. In addition, the printing form 6 can be stabilized mechanically by a gas cushion between the printing form 6 and the opposite surface of the mandrel 25. The gas cushion is formed by compressed gas in a narrow gap between the printing form 6 and the outer surface of the mandrel 25. Through the intermediary of the gas cushion, the printing form 6 can be pressurized perpendicularly to the surface and in the direction of the axis of rotation without any contact between the printing form 6 and the mandrel 25. The pressure is transmitted to the mandrel 25 by the gas cushion. Gas, i.e., air, for the air cushion is forced into the gap from fine nozzle openings 30 distributed over the outer surface of the mandrel 25. A supply duct 31 leads compressed gas to the nozzle openings 30. By supplying compressed gas into the gas cushion, cooling of the printing form is simultaneously also advantageously achieved for the printing process, because it is advantageous for the printing operation if, in addition to the heating, cooling of the gas quantity in the cavities is also performed.

The heating and cooling devices needed for the printing process can be incorporated into the mandrel 25. FIG. 4 shows a heating bar 7 with an optical fiber 12.

Hereinafter, for the purpose of graphically illustrating the processes for sucking printing ink into the cavities and expelling OR ejecting it from the cavities, reference is made to FIGS. 5 to 9, which show the different phases of a printing cycle, with regard to a cavity.

Figure 9:
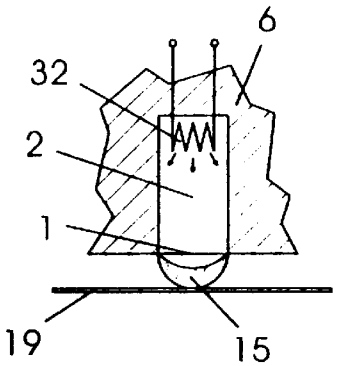
FIGS. 5 to 9 are enlarged fragmentary sectional views of the printing form, graphically illustrating the conditions in the region of a respective cavity and the opening thereof during individual steps of a printing cycle in which the pressure is generated by heating and cooling.
Figure 8:
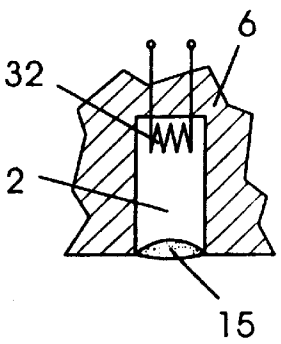
Figure 7:
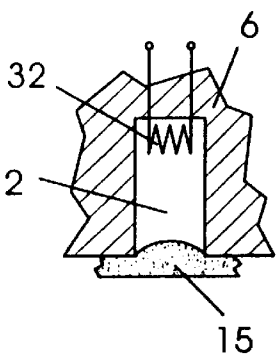
Figure 6:
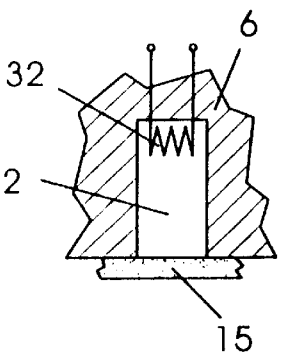
Figure 5:
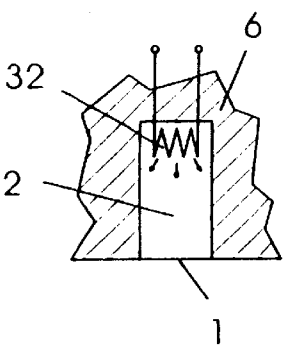

As show in FIGS. 5–9, a printing cycle is composed of heating the gas quantity (note FIG. 5) in selected cavities, in this case by a resistance heater 32, subsequently covering the openings with printing ink (note FIG. 6), thereafter cooling the heated gas quantity (note FIG. 7), then removing excess printing ink (note FIG. 8) and, finally, transferring printing ink from openings in the printing form to the printing material (note FIG. 9). The transfer/application can in this case be assisted by heating gas quantities in cavities.

Figure 13:
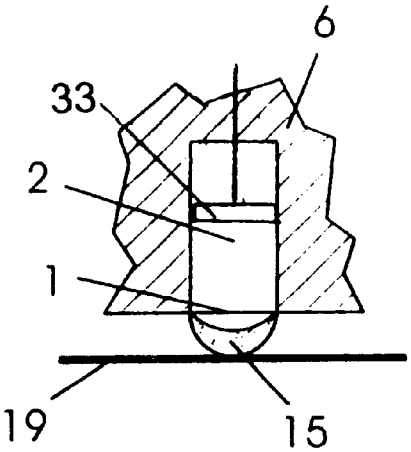
FIGS. 10–13 are enlarged fragmentary sectional views of the printing form, graphically illustrating the conditions in the region of a respective cavity and the opening thereof during individual steps of a printing cycle in which the pressure is generated by changing the volume of the cavity.
Figure 12:
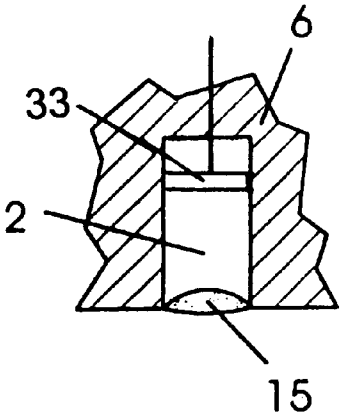
Figure 11:
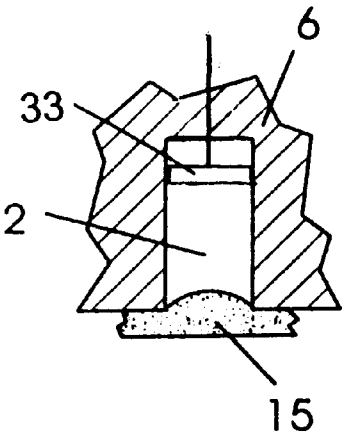
Figure 10:
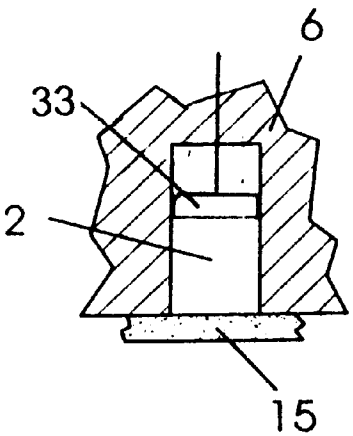

As shown in FIGS. 10–13, a printing cycle is composed of covering the openings with printing ink (note FIG. 10), thereafter enlarging the volume of the cavity (note FIG. 11) in selected cavities, in this case by a piston 33, then removing excess printing ink (note FIG. 12) and, finally, transferring printing ink from openings in the printing form to the printing material by reducing the volume of the cavities (note FIG. 13).

EXAMPLE

Casein emulsion ink (black Plaka ink from the firm Pelikan) thinned with water in the ratio of one part of ink by volume with two parts of water by volume can be used as the printing ink. A printing form according to the invention for printing with this printing ink includes a square, 10-mm thick plate made of Teflon. The length of an edge of the plate is 50 mm. At right angles to the surface, identical through-holes are introduced into the Teflon plate. Down to a hole depth of 1 mm, the through-holes have a diameter of 0.4 mm. Thereafter, the hole diameter widens from 0.4 mm to the diameter 0.9 mm. The holes in the plate form a raster or screen with a hexagonal structure. Between the raster or screen points, there is a distance of 2 mm. Glass tubes are pushed into the openings in the through-holes having the larger diameters. One end of the individual glass tubes, respectively, is closed, and the glass tubes are pushed in with the open end in front. The glass tubes are 15 mm long, have an outer diameter of 0.9 mm and an inner diameter of 0.4 mm, and they are pushed into the holes 9 mm deep. The gap between glass tube and the Teflon is sealed in a gastight manner with epoxy resin adhesive. One end of the glass tubes, respectively, is closed in a gastight manner by a drop of epoxy resin adhesive. The adhesive is pressed 2 mm deep into the glass tubes and, for each glass tube, encloses two 0.1 mm thick copper wires, respectively, which do not touch one another and are pushed 3 mm deep into the individual glass tubes, so that they pass through the adhesive layer into the interior of the glass tubes. The two copper wires are electrically connected in the glass tube to a 20-mm long thin Constantan wire. The nonreactive resistance of the bridge of Constantan wire is 4Ω. The Constantan wires, respectively, are located completely within the glass tubes. An electrical current which flows from the outside, via the copper wires, through the Constantan bridge heats the wires and causes the heating of the quantity of gas in the glass tube. The cavity in the glass tube and the volume of the 1-mm long part of the through-hole of 0.4 mm diameter in the Teflon form a cavity according to the invention in the printing form, with the 0.4 mm hole in the Teflon plate as an opening. Teflon is not wetted by the thin casein emulsion ink.

For the printing operation, the gas quantities of the cavities, the associated openings of which are supposed to suck up printing ink, are heated. This is effected with an electrical voltage of 1.2 volts, with which the resistance heaters in the selected cavities are supplied for 0.5 seconds. The openings in the printing form are covered with printing ink by a surge or flood of printing ink for 0.1 seconds before the power supplies for the resistance heaters are turned off. Two seconds later, when the gas temperature in the quantity of gas heated by the resistance heater has virtually reached ambient temperature again, the printing ink can be wiped off the surface of the printing form with a rubber doctor blade. Printing ink has now been sucked up by the openings with heated quantities of gas. In order to print on the printing material, the printing form is placed on the printing material. Then, for 0.5 seconds, the resistance heaters of all the cavities are supplied with an electrical voltage of 1.2 volts. This heats the respective quantities of gas in the cavities, as a result of which printing ink is forced onto the printing material from the openings in the printing form filled with printing ink by the gas pressure in the cavity.

I claim:

1. A printing form for transferring printing ink to a printing material comprising:

a body having a surface formed with a multiplicity of openings coverable by printing ink;

a multiplicity of gas-containing cavities formed in said body, said cavities, respectively, terminating in said openings, respectively, at said surface of said body; and devices operable at each of said cavities, respectively, for changing the gas temperature in said cavity before covering said cavity with printing ink for sucking printing ink covering said openings of said cavities into said cavities.

2. The printing form according to claim 1, wherein said devices, respectively, for changing the gas temperature in the respective cavities includes a cooling device for cooling a gas in the cavity, when the respective opening of the respective cavity is covered with printing ink, for subjecting the gas in said cavity to a vacuum for sucking the printing ink into the cavity.

3. The printing form according to claim 1, wherein said devices, respectively, for changing the gas temperature in the respective cavities have a heater for heating the gas in the respective cavities by previously heating the gas in the respective cavities and, then, cooling the gas in the respective cavities, when the respective opening of the respective cavity is covered with printing ink, for subjecting the gas in said cavity to a vacuum for sucking the printing ink into the cavity.

4. The printing form according to claim 3, wherein said heater is formed as a resistance heating element.

5. The printing form according to claim 3, wherein said heater is formed as a heating element heatable by absorption of electromagnetic radiation.

6. The printing form according to claim 5, wherein said heating element has a metal oxide.

7. The printing form according to claim 1, wherein said devices for changing the gas temperature in the respective cavities are operative by one of inductively, capacitively and resistively coupling energy into gas volumes in the respective cavities.

8. The printing form according to claim 1, wherein said devices for changing the gas temperature in the respective cavities are operative by absorption of electromagnetic radiation by gas volumes in the respective cavities.

9. The printing form according to claim 1, wherein said devices for changing the gas temperature are energizable by at least one of capacitive coupling, inductive coupling, and electromagnetic radiation.

10. The printing form according to claim 1, including devices assigned to said cavities for participating in applying printing ink from the respective cavities to the printing material.

11. The printing form according to claim 10, wherein said devices for participating in applying printing ink to a printing material, and said devices for changing the gas temperature in the cavities have common elements arranged on said body.

12. The printing form according to claim 10, wherein said cavities are positively pressurizable for at least partially ejecting printing ink therefrom.

13. The printing form according to claim 12, wherein the gas in the respective cavities is heatable so as to eject at least part of the printing ink from the respective cavities.

14. The printing form according to claim 10, wherein said devices for participating in applying printing ink from the respective cavities to the printing material are differently operatable for applying different quantities of the printing ink.

15. The printing form according to claim 1, wherein said devices for changing the gas temperature in the respective cavities are operatable so that vacuums of different strengths are settable in the respective cavities for sucking into the respective cavities different quantities of printing inks.

16. The printing form according to claim 15, including devices for participating in applying printing ink from the respective cavities to the printing material, said devices for participating in applying printing ink being operatable in accordance with the operation of said devices for changing the gas temperature in the respective cavities.

17. The printing form according to claim 1, wherein said gas in said cavities is air.

18. A printing form for transferring free-flowing printing ink to a printing material to be printed, comprising a body having a surface formed with a multiplicity of openings, a multiplicity of cavities formed in said body and terminating in said openings, respectively, said cavities being filled with gas, and devices for producing a vacuum assigned to said cavities, respectively, for heating said gas in said cavities, whereby, after heating the gas in a respective cavity, covering the opening of the cavity with printing ink, and subsequently having the gas in the cavity cooled, the printing ink is sucked into a region close to the opening of the cavity.

19. The printing form according to claim 18, wherein said device for producing the vacuum in said cavity is constructed as a resistance heating element.

20. The printing form according to claim 18, wherein said device for producing the vacuum is constructed as a heating element heatable by absorption of electromagnetic radiation.

21. The printing form according to claim 20, wherein said device for producing the vacuum has a metal oxide.

22. The printing form according to claim 18, wherein at least one of, on the one hand, said devices for producing the vacuum in the respective cavities in said body and, on the other hand, a gas volume in said cavity, serve for providing energy for producing a vacuum in a respective cavity in the body by at least one of capacitive coupling, inductive coupling and electromagnetic radiation.

23. The printing form according to claim 18, including devices assigned to said cavities for participating in applying printing ink from one of said cavities, respectively, to the printing material.

24. The printing form according to claim 23, wherein said devices for participating in applying printing ink to the printing material, and said devices for producing a vacuum in the cavities have common elements arranged on said body.

25. The printing form according to claim 24, wherein the gas in the respective cavity is heatable for ejecting at least part of the printing ink from the respective cavity.

26. The printing form according to claim 23, wherein said devices for participating in applying printing ink from the cavities to the printing material are operatable differently for applying different quantities of printing ink.

27. The printing form according to claim 18, wherein said devices for producing vacuum in the cavities are operatable so that vacuums of different strength are settable in the cavities for sucking different quantities of printing inks into said cavities.

28. The printing form according to claim 27, wherein said devices for applying printing ink from the cavities to the printing material are operatable in accordance with the operation of said devices for producing the vacuum in the cavities.

29. The printing form according to claim 18, wherein said gas in said cavities is air.

30. A device for transferring printing ink from a printing form to a printing material, comprising:

a transport device for transporting, along a transport path, the printing material to be printed; and a printing form past the surface of which the printing material is movable, said printing form including:

a body having a surface formed with a multiplicity of openings coverable by printing ink;

a multiplicity of gas-containing cavities formed in said body, said cavities, respectively, terminating in said openings, respectively, at said surface of said body; and devices operable at each of said cavities, respectively, for changing the gas temperature in said cavity before covering said cavity with printing ink for sucking printing ink covering said openings of said cavities into said cavities.

31. A method for transferring printing ink from a printing form to a printing material, which comprises:

covering openings formed in the surface of the printing form with the printing ink, the printing ink being located within the openings and in regions adjacent the openings;

producing a vacuum in cavities opening into the openings, respectively, by cooling a gas volume of the cavities while covering the openings with the printing ink;

sucking the printing ink into the cavities; and applying the printing ink from the cavities to the printing material.

32. The method according to claim 31, which includes sucking printing ink into the openings and into the regions adjacent to the openings of all the cavities in a group of the cavities, and performing the application by a selective application of excess pressure within selected cavities in this group of cavities.

33. The method according to claim 31, which includes sucking printing ink into the openings of selected cavities in a group of cavities and into the regions adjacent to said openings.

34. The method according to claim 31, which includes heating the gas volume of the cavities before the openings are covered with printing ink.

35. The method according to claim 34, which includes providing a heater for performing the heating.

36. The method according to claim 34, which includes, for heating the gas in the cavities, providing at least one of direct inductive, capacitive and resistive coupling of energy and absorption of electromagnetic radiation by the gas.

37. The method according to claim 31, which includes participating in applying printing ink from cavities to printing material by producing excess pressure in the respective cavity.

38. The method according to claim 37, which includes performing the application of the printing ink from cavities selectively having printing ink in a group of cavities by applying excess pressure in all the cavities of a group of cavities.

39. The method according to claim 37, which includes producing the excess pressure in the respective cavity by heating the gas volume in the respective cavity while covering the opening thereof with printing ink.

40. The method according to claim 37, which includes setting the excess pressure in the respective cavity to different values.

41. The method according to claim 31, which includes setting the vacuum in the cavities to different values.

42. The method according to claim 31, which includes filling the cavities with air.

43. A printing form for transferring printing ink to a printing material, comprising:

a body having a surface formed with a multiplicity of openings coverable by printing ink;

a multiplicity of gas-containing cavities formed in said body, said cavities, respectively, terminating in said openings, respectively, at said surface of said body;

and devices assigned to said cavities, respectively, for producing a vacuum therein for sucking printing ink covering said openings of said cavities into a region adjacent to said openings of said cavities, respectively, when a vacuum is produced by said devices in said cavities, respectively;

wherein the respective devices for producing a vacuum in the respective cavities have at least one wall region which is at least one of deformable and movable for changing the volume of the respective cavities, so that when the respective openings of the respective cavities are covered with printing ink, the gas therein is subjectable to a vacuum that sucks printing ink into the respective cavities by at least one of deforming and moving the respective wall regions for the purpose of enlarging the volume of the respective cavities.

44. The printing form according to claim 43, wherein said wall regions of the respective cavities are prestressed into a first position, and including an actuator for transferring said wall regions from said first position thereof into a second position thereof, the volume of the respective cavities in said first position of the wall region being greater than in said second position thereof.

45. A printing form for transferring printing ink to a printing material, comprising:

a body having a surface formed with a multiplicity of openings coverable by printing ink;

a multiplicity of gas-containing cavities formed in said body, said cavities, respectively, terminating in said openings, respectively, at said surface of said body;

devices assigned to said cavities, respectively, for producing a vacuum therein for sucking printing ink covering said openings of said cavities into a region adjacent to said openings of said cavities, respectively, when a vacuum is produced by said devices in said cavities, respectively; and devices assigned to said cavities for participating in applying printing ink from the respective cavities to the printing material, wherein a respective wall region of each of the cavities is one of deformable and movable for reducing the volume thereof so as to eject at least part of the printing ink from the respective cavities.

46. A method for transferring printing ink from a printing form to a printing material, comprising:

providing the printing form with cavities opening into openings formed in the surface of the printing form, covering the openings in the printing form with printing ink, the printing ink being located within the openings and in regions adjacent to the openings of the cavities, producing a vacuum in the cavities for sucking the printing ink within the openings into the cavities, the vacuum being produced by enlarging the volume of the cavities, and applying the printing ink from the cavities to the printing material.

47. A method for transferring printing ink from a printing form to a printing material, comprising:

providing the printing form with cavities opening into openings formed in the surface of the printing form, providing printing ink being located within the openings and in regions adjacent to the openings of the cavities, sucking the printing ink within the openings into the cavities and applying the printing ink from the cavities to the printing material by producing excess pressure in the respective cavity, the excess pressure being produced by reducing the volume of the cavities while covering the openings thereof with printing ink.

* * * * *

UNITED STATES PATENT AND TRADEMARK OFFICE

CERTIFICATE OF CORRECTION

PATENT NO. : 6,651,560 B2
DATED : November 25, 2003
INVENTOR(S) : Dietmar Neuhaus It is certified that error appears in the above-identified patent and that said Letters Patent is hereby corrected as shown below:

Title page,
Item [73], Assignee should read as follows:
-- Heidelberger Druckmaschinen AG, Heidelberg (DE)
Dietmar Neuhaus, Düsseldorf (DE) --

Signed and Sealed this

Twenty-seventh Day of July, 2004

JON W. DUDAS
*Acting Director of the United States Patent and Trademark Office*